US007744512B2

(12) United States Patent
Clarke

(10) Patent No.: US 7,744,512 B2
(45) Date of Patent: Jun. 29, 2010

(54) AEROBIC RESISTANCE EXERCISE DEVICE

(76) Inventor: Paul A. N. Clarke, 2079 The Collegeway, Unit 102, Mississauga, Ontario (CA) L5L 3M1

( * ) Notice: Subject to any disclaimer, the term of this patent is extended or adjusted under 35 U.S.C. 154(b) by 0 days.

(21) Appl. No.: 12/402,591

(22) Filed: Mar. 12, 2009

(65) Prior Publication Data

US 2009/0258768 A1 Oct. 15, 2009

Related U.S. Application Data

(60) Provisional application No. 61/035,860, filed on Mar. 12, 2008.

(51) Int. Cl.
*A63B 21/02* (2006.01)

(52) U.S. Cl. ..... 482/124

(58) Field of Classification Search ..... 482/43, 482/74, 88, 121–126, 139; 2/102
See application file for complete search history.

(56) References Cited

U.S. PATENT DOCUMENTS

| | | | | | |
|---|---|---|---|---|---|
| 1,402,179 | A | * | 1/1922 | Piscitelli | 482/124 |
| 1,432,013 | A | | 10/1922 | Blake | |
| 2,097,376 | A | | 10/1937 | Marshman | |
| 2,613,932 | A | | 10/1952 | Manners | |
| 3,162,441 | A | | 12/1964 | Karlik | |
| 3,999,752 | A | | 12/1976 | Kupperman et al. | |
| 4,961,573 | A | | 10/1990 | Wehrell | |
| 4,993,705 | A | | 2/1991 | Tolle | |
| 5,137,272 | A | | 8/1992 | Wilkinson | |
| 5,186,701 | A | | 2/1993 | Wilkinson | |
| 5,203,754 | A | | 4/1993 | Maclean | |
| 5,306,222 | A | * | 4/1994 | Wilkinson | 482/124 |
| 5,308,305 | A | | 5/1994 | Romney | |
| 5,372,565 | A | | 12/1994 | Burdenko | |
| 5,514,059 | A | * | 5/1996 | Romney | 482/124 |
| 5,727,254 | A | | 3/1998 | Dicker | |
| 5,792,034 | A | * | 8/1998 | Kozlovsky | 482/124 |
| 5,813,955 | A | | 9/1998 | Gutkowski et al. | |
| 5,993,362 | A | * | 11/1999 | Ghobadi | 482/124 |
| 6,007,463 | A | * | 12/1999 | Wells et al. | 482/126 |
| 6,059,697 | A | | 5/2000 | Breems | |

(Continued)

OTHER PUBLICATIONS

'Be "Nimbo" . . . Be Quick'; Millionaire Blueprints; Jan. /Feb. 2009, pp. 69-71.

*Primary Examiner*—Loan H Thanh
*Assistant Examiner*—Allana Lewin
(74) *Attorney, Agent, or Firm*—Gerald A. Gowan; Gowan Intellectual Property

(57) ABSTRACT

An exercise device comprises an elastic member with foot straps its ends for attachment to a user's feet, which is secured to a vest which encircles upper chest region, and passes through an inverted "U" enclosed pathway affixed to the vest. Additional elastic members are provided that attach to the first elastic member, and to grasping elements that attach to a user's hands. The additional elastic members preferably connect to the first elastic member, and pass through guide means located at or near the openings of the pathway. Clips or rings are provided on the elastic members that can be used to shorten the length of the elastic members and/or add additional elastic members to the device, and thus modify the tension encountered. In use, the elastic member is put into tension, so that movement of the legs or arms is against the elastic resistance of the elastic member.

19 Claims, 3 Drawing Sheets

U.S. PATENT DOCUMENTS

| | | | | |
|---|---|---|---|---|
| 6,132,346 | A | 10/2000 | Weeks | |
| 6,659,921 | B2 * | 12/2003 | Vernon | 482/124 |
| 6,691,318 | B1 * | 2/2004 | Davis | 2/102 |
| 6,921,357 | B2 * | 7/2005 | Basting | 482/121 |
| 7,175,574 | B2 | 2/2007 | Carmel at al. | |
| 2005/0101461 | A1 | 5/2005 | Johnson | |
| 2005/0113221 | A1 | 5/2005 | Dovner et al. | |
| 2005/0282689 | A1 | 12/2005 | Weinstein | |
| 2006/0040805 | A1 | 2/2006 | Wilkinson | |
| 2007/0213186 | A1 * | 9/2007 | Longo | 482/121 |
| 2009/0062087 | A1 * | 3/2009 | Poppinga | 482/124 |

* cited by examiner

AEROBIC RESISTANCE EXERCISE DEVICE

RELATED APPLICATIONS

This application claims the benefit of priority under 35 U.S.C. §119(e) to U.S. Provisional Application Ser. No. 61/035,860 filed on Mar. 12, 2008, the entirety of which is hereby incorporated by reference.

FIELD OF THE INVENTION

This invention relates to exercise devices, and particularly to exercise devices which are intended to provide elastic resistance against which any group or chosen groups of muscles may be aerobically exercised. In particular, the present invention relates to exercise devices which are lightweight, portable, and inexpensive. Moreover, the present invention relates to exercise devices of the sort where the lightweight device may be quickly and easily fitted to, and removed from, the body of the user. The exercise device of the present invention is particularly useful for exercising various muscle and muscle groups, either together or separately, in the upper torso (including but not limited to, the chest, shoulders, or arm) and the lower torso (including but not limited to the legs and hips) of the user.

BACKGROUND OF THE INVENTION

Resistance training strengthens and conditions the body. It reduces the loss of muscle mass while creating a stronger, toned body. Additional benefits include providing improved posture, and aiding in the prevention of osteoporosis, or the like. Resistance exercises often involve lifting, pushing or pulling various objects including pulley systems, spring systems, elastics bands and tubing, and more traditionally, various weighted materials including free weights, plates, or the like.

Resistance training devices generally have limitations, or other drawbacks, in that the number of muscles or muscle groups they can effectively simultaneously impact at one time, is limited. As a result, during a user's exercise routine, it may be necessary to change or add various components or other devices, in order to achieve the full impact of the training. Those added devices which can provide a comprehensive workout, are typically very heavy, can result in equipment which requires an excessive amount of space, can be complex to set up and modify, and commonly require foreign objects, such as a pull bars, or the like, as part of the equipment setup. In addition, modification of the components during an exercise routine can be inconvenient, as well as being costly and/or time consuming.

Aerobic exercises are designed to be performed over a period of time as opposed to, say, weight lifting where the lifter exerts highly intense muscular contractions but only for a very short period of time. In contrast, aerobic exercises are designed and arranged to improve the fitness of various groups of muscles in the body, and the duration of the exercise is such is that glycogen or sugar will be consumed by the body muscles. Thus, in general, aerobic exercises are performed at a low to moderate level of intensity over a long period of time. For example, running over a long period of time is an excellent aerobic exercise, as opposed to sprinting which is not.

A number of benefits may be achieved over a period of time, including, for example, strengthening the muscles which are involved in breathing, strengthening and enlarging the heart muscle to improve its pumping efficiency and reduce the resting heart rate, toning muscles throughout the body so as to improve overall circulation and reduce blood pressure, and to increase the total number of red cells in the body's and thereby to facilitate transport of oxygen throughout the body.

As noted, distance running is good form of aerobic exercise, but that usually means running out of doors, possibly in inclement weather, or driving to a gymnasium or other exercise facility which is fitted with a track. Devices have also been brought to the market over the years which permit the user to perform aerobic exercises in the comfort and privacy of their own home. Such devices are either very simple, such as a skipping rope, or more typically are very expensive and/or complicated to assemble and use. Moreover, aerobic exercise devices are also usually fairly large and heavy, and take up considerable room.

Further, however, other aerobic exercise devices have been devised which are essentially garments which are worn on the body of the user, and in many respects appear to be no different than a wet suit which is worn by a diver. That is, those kind of aerobic exercise devices require that the user insert his/her arms and legs into the arms and legs of the body suit.

The present inventor has unexpectedly discovered that a simple vest-like garment can be supplied which encircles only a portion of the upper part of the body of the user, and is supported by the shoulders of the user, but which otherwise does not require that the arms or legs of the user be enclosed in sleeves or legs of the garment. Moreover, the exercise device of the present invention may be constructed with mesh material for the most part, so as to avoid overheating of the user's body and to permit the evaporation of perspiration therefrom, thereby keeping the body of the user cooler than it might be otherwise.

Further, a principal feature of the present invention is the fact that the key element of the invention is a first long elastic member, the elastic strength of which the various muscle and muscle groups will work against. The long elastic member is positioned on the back of the user in such a manner that it maintains its configuration and placement with respect to the back and hips of the user. When the elastic member is in tension, its length will change in that it will become longer. The elastic memory of the member will, however, attempt to restore the length of the elastic memory to its initial, at rest length, so that when the legs or hands of the user are moved, such movement will be against the resistance caused by the elastic memory and the tensile force which develops in the elastic member. That point alone distinguishes the present invention over the other similar aerobic exercise devices which have heretofore been available.

Additionally, however, a series of "rings" are strategically located on the elastic member that provide the following benefits, namely: facilitating the targeting of various muscle and muscle groups in the body from a readily accessible, central location; facilitate the addition of additional levels of resistance to the device; and in some cases, facilitate the modification of the tension or resistance encountered during a specific exercise.

DESCRIPTION OF THE PRIOR ART

The nature of the prior art, and the constraints and restrictions thereof, are illustrated by reference to the following three issue United States patents.

Karlik, in U.S. Pat. No. 3,162,441 teaches a so-called universal exerciser whose purpose is to provide an exercising device which will permit a wide variety of exercises, particularly pulley exercises. The device comprises a plurality of coil springs, at the ends of which pulleys are arranged so as to accommodate a cord or other flexible line whose length remains constant throughout the performance of any exercise which can be done on the device.

Wehrell, in U.S. Pat. No. 4,961,573 teaches an exercise harness which is designed to train and condition the user insofar as that user's arm speed, endurance, and power are concerned. This device comprises a harness which encircles the chest of the user, and provides, at the back thereof, independent pathways for two independent elastic cords. One end of each of the elastic cords is connected to a handle, and the other end is unattached. Two cleats are secured to a rigid or semi-rigid plate which extends across the back of the user or are attached to the two cords in a manner so that the path which each of the cords follows may be lengthened or shortened.

Wilkinson, in Britain U.S. Pat. No. 5,186,701 teaches an aerobic resistance exercise garment which is such as to effectively supplement selected motion exercises. This garment is required to be worn on the body and has anchor members at the hand or foot and which are connected one to another by an elastic material. Here, there are a plurality of cords which are independent one from another so that each of the arms and legs has its own respective cord associated therewith.

SUMMARY OF THE INVENTION

In accordance with one aspect of the present invention, there is provided an exercise device for performing a variety of aerobic resistance exercises, whereby a chosen muscle group or groups may be aerobically exercised by moving against an elastic resistance. The exercise device comprises a first elastic member having a predetermined length when at rest; a foot strap element at each end of the first elastic member and adapted to accommodate the feet of the user; a vest which encircles at least the upper chest and back region of the body of the user; and an substantially enclosed pathway having an inverted "U" configuration affixed to the vest. Part of the first elastic member is positioned within the enclosed pathway. In this manner, the first elastic element is placed in close proximity to the back of the user.

When the exercise device is first placed on the body of the user, the predetermined length is such that the foot strap elements are above the feet of the user. When the exercise device is used, the foot strap elements are physically in place with the feet of the user, and the first elastic member is placed into a first tensile force. Accordingly, movement of the legs of the user which are associated with the strap elements will be against the elastic resistance of the elastic member.

The vest is preferably held on the user by a pair of vest straps which go over the shoulders of the user, and a belt which encircles the user just below chest level. The vest straps are attached at one end to the back panels of the vest, and at their opposite end to the belt at the front of the user. The vest straps and belt are preferably adjustable in length by using Velcro type fasteners, double D-rings, or other releasable means, so as to accommodate the various body sizes and shapes of the user.

A plurality of "clips" or "rings" are secured to the first elastic member along the length of each leg of the "U" configuration, in the regions of the first elastic member that are not in the enclosed pathway. Preferably, the clips or rings are spaced at regular intervals along the length of each leg of the U-configuration. The clips or rings can be any suitable device such as a ring, D-ring, fastener hook, or the like, and typically, each leg of the first elastic member will have 2 to 10 clips or rings, and more preferably, between 3 and 6 clips or rings on each leg.

The rings can be any simple ring structure, or equivalent such as a D-ring or the like. The clips are preferably fastening means such as fastener hooks, or the like, which are adapted to be connected to any of the rings or any other clips. A combination of both rings and clips can be provided at one or a plurality of locations.

Further, in one embodiment, each leg might have only rings, and an external fastener, such as will be discussed hereinbelow, can be utilized.

In this fashion, any pair of clips, or rings, in each leg of the "U" configuration may be affixed to any other clip, or rings using an additional or integral clip, so as to effectively shorten the at-rest length of the elastic member between the foot strap elements; so that when the exercise device is used by a user for whom the predetermined length is intended, the initial tensile force in the elastic member will be increased.

Preferably, the exercise device further comprises a pair of second elastic members which are preferably affixed to the vest of the first elastic member in the region near the opening of each leg of the pathway. When attached to the first elastic member, the second elastic member is held in place with a guide means that acts to prevent excessive movement of the first elastic member as the second elastic member is placed into tension.

Further, in such a case the ends of the second elastic members have grasping elements which are adapted to fit to the hands or wrists of the user. The second elastic members have a second predetermined length such that when the exercise device is first placed on the body of the user, the second predetermined length is such that the grasping elements are located at a length between the shoulder and wrist of the user. When the exercise device is used, the grasping elements are in place in the hands of the user, and the second elastic member is placed into a second tensile force. Accordingly, movement of the hands or arms of the user which are associated with the grasping elements will be against the elastic resistance of the second elastic member.

When the exercise device is in use where the user has both hands in the grasping elements, and both feet in the foot strap elements, each of the first elastic member and the pair of second elastic members are put into tension according to their respective tensile strengths.

However, it is to be noted that putting the second elastic member into tension can result in increased tension on the first elastic member if the second elastic member is attached to the first elastic member. This is particularly relevant if the guide means is not used, or is disengaged.

Accordingly, the legs and/or arms of the user may be aerobically exercised simultaneously against the respective elastic resistances of either or both of the first elastic member or the second elastic members as the two elastic members increase in tension during performance of any selected exercise.

The second elastic member can also include clips or rings, as previously described, in which the length of the second elastic member can be shortened, and thus the tensile force the second elastic member, increased (in the manner previously described with respect to the first elastic member).

Using the resistance of the first elastic member alone can be used in exercises directed at, for example, but not limited to, the user's legs or lower torso. The resistance of the second elastic member, for the most part, is used for exercises of the user's chest or upper torso. However, since the second elastic member can be attached to the first elastic member, some resistance for the arm or upper torso exercise can result from the first elastic member. However, when the second elastic member is attached directly to the vest, it is preferably near the opening of the legs of the U-shaped pathway, and the resistance for the upper torso, via arm exercises, results simply from the second elastic member.

When the second elastic element is attached to the first elastic element, there are preferably optional guide means at each side of the vest near the openings of the U-shaped pathway. Preferably the guide means and pathway openings having a spacing between them which is greater than at least at least 50% of the width of the user's back, and more preferably, has a spacing between them of greater than at least 90% of the width of the user's back. Most preferably, the guide means and pathway openings are separated by the width of the user's back, and are generally located at or near the sides of the user, and at an elevation which is in the region of the user's below the armpits and above the waist.

When the guide means are present, the first elastic member, but more preferably each of the second elastic member is passed through, or is acted upon, by one of the respective guide means. The guide means can simply be a loop of strapping material that can be fitted around the second elastic elements.

It can further be noted that when the second elastic member is attached directly to the vest, or when the second elastic member is attached to the first elastic element through the guide means, the ends of the legs of the first elastic member do not need to be attached to the feet of the user, while arm-only, or upper torso exercises are conducted.

Further still, a third elastic member can also be preferably provided which connects between the belt, at or near the front of the user, and the two downwardly extending legs of the first elastic member. This third elastic member is used so as to draw the first elastic member forward. This provides a more balanced tension on the user from the first elastic element, which tension is directed down the user's sides. Less elastic force is directed to a position located behind the user.

The usual format of the first, second or third elastic member, or any other elastic member described herein, is an elastic tube, common in exercise equipment design. However, it will be understood by those skilled in the art that other kinds of elastic cords may be employed. Thus, it will also be understood that any or all of the elastic members which may be employed in the construction of the exercise device in keeping with present invention, may be elastic tubes or other suitable elastic cords.

Moreover, any or all of the elastic members, and most importantly, the first elastic member, may comprise at least two or more short elastic tubes connected lengthwise to one another in such a manner that the overall length of the first elastic member is still the predetermined length.

Still further, the first elastic member may comprise at least three or more short elastic tubes connected lengthwise one to another so that, once again, the overall length of the first elastic member is the predetermined length. Further, it should be noted that the tensile strength of the various component parts can be different one from the other, so that the overall tensile strength of the first elastic member can be modified and/or so that the tension encountered during arm exercises can be specifically modified. This can be accomplished by, for example, modifying the tension of the first elastic member component housed within the U-shaped pathway.

An additional elastic member, optionally having a higher tensile strength than the first elastic member, may be affixed to any pair of clips or rings in each leg of the "U" configuration. The additional elastic member can also be of a different and shorter length than the length normally found between adjacent, or non-adjacent rings or clips, so that when the exercise device is used, the initial tension will be increased.

Optional grasping means can be provided which comprise a hand hold element, a strap, and a ring and/or clip for attachment to any ring or clip on the exercise device. This optional grasping means can be used to provide a means to use the arms against the tensile force of the first elastic member by attaching the optional grasping means to the first elastic element, or can simply be used as the clipping means to attach two rings on the first elastic element, together. The optional grasping means can be attached to the first, optionally the second, or the fourth elastic member (as discussed hereinbelow).

This optional grasping means can also be fitted with a further elastic member, if desired.

The optional grasping means, with or without the further elastic member, can also be used to in order to modify the tension encountered during an exercise. For example, an exercise where the tension of the first elastic member is too high for a certain user, can be modified by having this optional grasping means with an additional elastic member attached thereto so that the user can have less resistance during the performance of the exercise. Thus the user can modify the tension encountered during the exercise.

An optional fourth elastic member can also be provided which is adapted to be positioned between the feet of the user. A series of between 1 and 5, and more preferably, between 2 and 5, clips or rings can also be provided on this fourth elastic member. This provides resistance between the user's feet during selected exercises.

Finally, in any exercise device in keeping with the present invention, the predetermined length of the respective first elastic member is preferably chosen so as to accommodate the physical size of the user. Accordingly, when the exercise device is in use by a respective user for whom the predetermined length of the first elastic member has been provided—a man, woman, teenager, or child—the first elastic member will be put into tension, and the resistance against which the exercise will be performed is that first tensile force in the first elastic member.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

Figure 1:
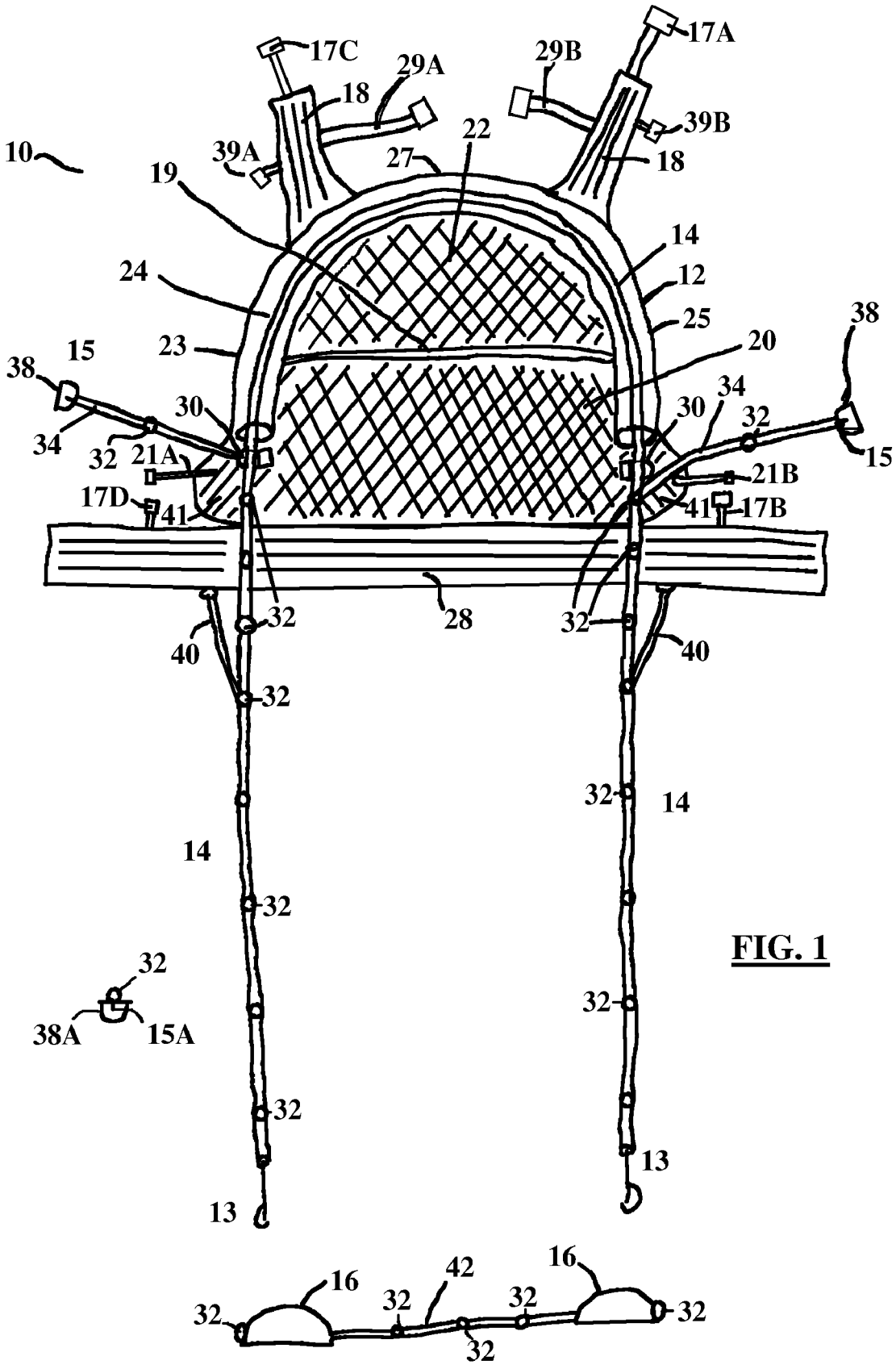
FIG. 1 is a schematic representation of the principal components and features of an exercise device in keeping with the present invention, and intended for use in the performance of resistance and/or aerobic exercises.

Turning first to FIG. 1, a schematic representation of an exercise device in keeping with present invention is shown at 10. It will be understood that the device as it is illustrated in FIG. 1 is as seen from the back of the user.

The principal components of the exercise device which is shown are a vest 12 which is adapted to encircle at least the upper chest and back region of the body of the user. There is a first elastic member 14, at the ends of which are clips 13, for attaching to foot straps 16. Foot straps 16 are typically adjustable length straps which are primarily intended to be fitted around each foot of the user. Clips 13 are any suitable fasteners adapted to be fitted to foot straps 16, and preferably, are adapted to be connected to a simple metal or plastic ring 32, as discussed hereinbelow, attached to foot straps 16.

It will be understood, of course, that the first elastic member 14 has a predetermined length when at rest—that is, when it has not been placed in tension. That predetermined length will ordinarily be such that, when the first elastic member is intended for use on the legs of the user, the clips 13, found at the ends of first elastic member 14, will be found generally in the position of the knees of the user. It will be further understood, of course, that the predetermined length and size of the first elastic member 14 may be different from one exercise device 10 to another, whereby various manufactured exercise devices may be worn by any member of my family, for example, such as by children, teenagers, and adult men and women having various physical appearances insofar as their girth and height may be concerned. In any event, it will be understood that when the foot straps 16 are attached to clips 13, and foot straps 16, are place on the feet of user, there will be a first initial tensile force which develops in the elastic member, and against the resistance of which aerobic exercises will be performed.

A pair of vest straps 18 are provided, and they are intended to go over the shoulders of the user, and connect to a belt 28 by connecting adjustable strap ends 17A to 17B, and 17C to 17D, in any known manner.

A back panel 20 is provided so as to extend across at least the upper back region of the user, especially between the shoulder blades. The major central region of the back panel 20 is typically made of a mesh material for purposes of maintaining the body of the user cooler than it might otherwise be.

An optional pack or pocket 19 can be provided on the back of panel 20 for storage of the various elastic tubing components, when any of these are not in use. Other pockets can be provided as desired for storage of any other devices, such as CD players, radios, iPods, or the like.

A principal feature of the present invention is the provision of an enclosed pathway 24, shown as a clear pathway for illustrative purposes, which is affixed to the vest 12 in the back region thereof, and which provides a pathway or "tunnel" through which the first elastic member 14 is passed. Thus, it can be seen that whether or not the first elastic member is in tension or is not in tension, its placement with respect to the back and shoulders of the user will be substantially in a fixed position. It will also be appreciated that the configuration of the enclosed pathway 24 is substantially in an inverted "U" so that the legs 23 and 25 of the pathways 24 thereof extend downwardly with respect to an apex 27.

It will be appreciated that exercises such as leg extensions or squats may be performed when the foot straps 16 are associated with the feet of the user so that the first elastic member is in tension prior to any exercise being performed.

So as to assist the placement of the vest 12 in a body encircling manner, the vest is also provided with a weblike belt or girdle 28 which extends around the body on the user and fastens at the front thereof in any known manner, such as with Velcro fasteners. Typically, the length from top to bottom of the vest 12—that is, from the uppermost region of the back panel 22 to the lower edge of the belt 28—is such that the belt 28 will encircle the body of the user in the region between the armpits and waist, and usually more or less at or near the bottom of the rib cage or the area just below the chest.

A pair of second elastic members 34 are optionally attached to the first elastic member 14 at or near the openings of pathway 24. A hand grasping element 38 is provided at the end or each of second elastic members 34. A clip 15 such as a fastener, is included as part of hand grasping element 38. Clip 15 may be the same as, or different from, clip 13.

It will be understood, however, that second elastic member 34 may be attached directly to vest 12, or optionally to a ring 32, on first elastic member 14, both as shown in FIG. 1.

A further significant feature of the construction of the exercise device in keeping with the present invention is the provision of optional guide means 30 which are affixed to the vest 12 in the area of the opening of the ends of pathway 24, and through which first elastic member 14 or second elastic members 34 can also pass when they are connected to first elastic member 14 or to vest 12. The guide means 30 may be a loop of material through which the first 14 and/or second elastic member 34 may pass in a reasonably frictionless manner, or guide means 30 may be a pulley, or the like. However, it should be noted that the spacing between the two guide means 30 is preferably at least 50% of the width of the user's back, and more preferably is the width of the back, apart, in the region where belt 28 is placed. The spacing is preferably such that, in general, the guide members 30 are located near the sides of the user.

A third elastic member 40 is provided which is connected at one end to belt 28, and at an opposite end to first elastic member 14. Third elastic member 40 is connected to belt 28 at a point which will be located towards the front of the user, and thus, in front of the pathway 24 openings, or guide means 30. In use, this third elastic member 40 tends to pull the first elastic member 14 forward as it exits pathway 24, and provides a more vertically balanced feeling to the user.

A fourth elastic member 42 is fitted (either permanently or releasably) to foot straps 16 so that tension can be applied between the feet of the user, as and when desired in the performance of various exercises.

Referring still to FIG. 1, one additional feature of the present invention will be noted. That is, there are a plurality of rings 32 which are secured to the first elastic member 14 along the length of each leg of its "U" configuration, in regions which are not in the enclosed pathway 24. Indeed, the rings 32 are found on the first elastic member in the regions of each leg thereof which are below belt 28 and/or guide means 30. Rings 32 are preferably circular or D-shaped plastic or metal rings, that are attached to first elastic element. Rings 32 are adapted to receive a fastener clip, such as shown as the clip 15, and using clip 15, one ring 32 can be connected to another ring 32, in the manner described hereinbelow.

Rings 32 may also be attached together using an optional hand grip 38A, shown having a clip 15A, (in combination with further ring 32) which can be attached to any one ring 32, or to a combination of rings 32.

However, it must be noted that rings 32 are such that a clip 15, or any pair of clips 15 on either one of the legs of the first elastic member 14 may be affixed or connected to any other ring 32 on the same leg, so as to thereby effectively shorten the at rest length of the elastic member. Accordingly, if the exercise device is used by a user for whom the predetermined length of the first elastic member is correct (adult, teenager, child, etc.), then the effectively shortened first elastic member will be in greater tension, and the initial tensile force in the elastic member will have increased over that of a first elastic member when in its original placement. This is described later in association with FIGS. 4 and 5.

Rings 32 are also found on second elastic member 34, and can be used to shorten the length of member 34. Further, rings 32 are also found on fourth elastic member 42 to adjust the length of member 42.

Optionally, adjustable straps can be provided to ensure a snug fit of vest 12 on each user, by attaching optional adjustable straps 21A to 21B, or 39A to 39B, and/or 29A to 29B. Further, optional protective tabs 41 can be provided on vest 12, which prevent any elastic tubes from rubbing directly against the user.

Figure 2:
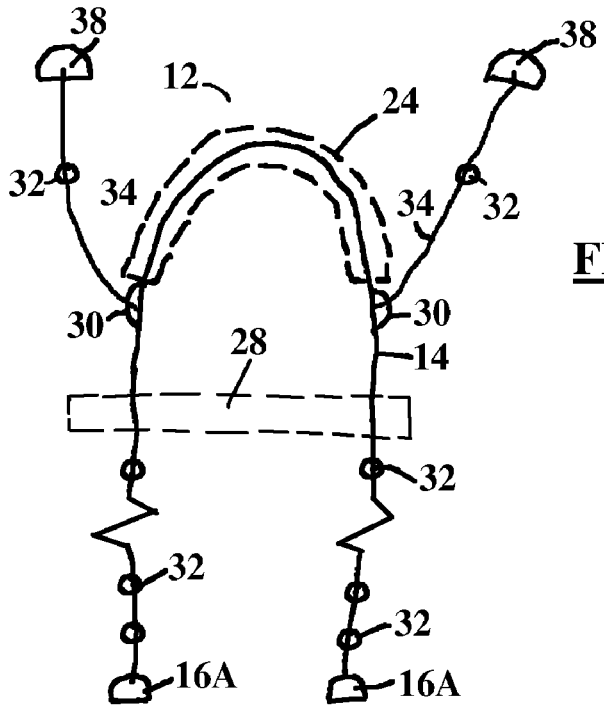
FIG. 2 is a schematic representation of the principal components, where an additional pair of components has been added.

Referring now to FIG. 2, a modification of the exercise device which has so far been described is shown in schematic manner. Here, it is seen that the foot straps 16A are permanently affixed to the end of first elastic member 14. It can be seen that second elastic members 34 are affixed to first elastic member 14 in the area immediately adjacent to guide means 30.

Each of the second elastic members 34 has a hand grasping member 38 secured to its outer end. The length of each of the elastic members 34 will be such that in their un-stretched, at-rest, form, the hand grasping members 38 will be found in a position somewhere between the wrists and the shoulders of the user. It will now be seen that the second elastic members 34 and their grasping members 38 may be employed in the performance of exercises that are primarily intended for the upper torso of the user, including the chest, shoulders, arms, hands, and wrists of the user. These can include, for example, shoulder or chest presses, or the like. To that end, the grasping members 38 may be designed so as to be grasped by the hand, to fit around the wrist, or both.

Typically, exercises using grasping member 38 are performed primarily against the resistance in second elastic member 34 as a consequence of its own elastic memory and the initial tensile strength thereof. However, because second elastic member 34 is attached to first elastic member 14, some of the total tension encountered during arm exercises also results from the tensile resistance of member 14.

Another option, however, is for second elastic member 34 to be connected directly to vest 12 so that virtually all of the tension is provided by second elastic member 34, as previously described.

Figure 3:
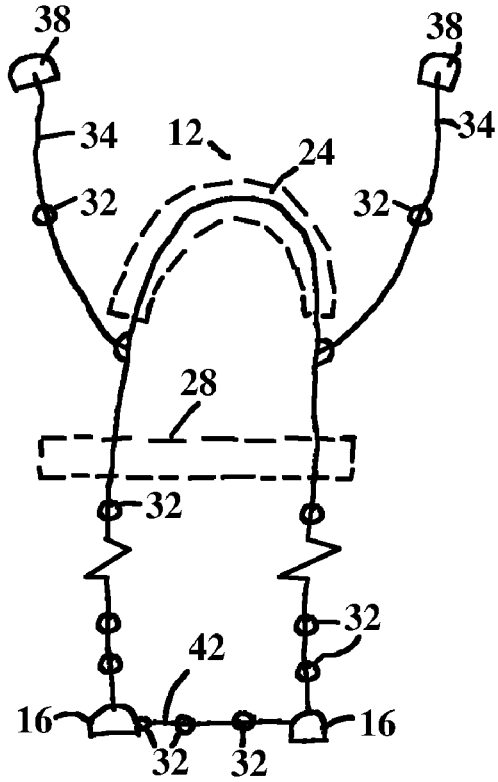
FIG. 3 is a schematic representation similar to that of FIG. 2, where yet an additional component has been added.

FIG. 3 is essentially the same as FIG. 2, except for the addition of fourth elastic member 42. That member 42 is permanently secured at one end to foot strap 16 which is associated with one foot of the user. The other end of member 42 can be releasably attached to the other foot strap 16 on the other foot of the user. When attached to both feet, additional exercises can be performed under tension. These include exercises such as hip abductions, single leg lifts to the front, side or back, and so on. When fourth elastic member is not needed, it can be un-connected from one foot strap 16, and wrapped around the other foot of the user.

The length of fourth elastic member 42 can be adjusted using clips 32 so that the tension applied can be adjusted, and thus modify the type and nature of the exercise.

Figure 4:
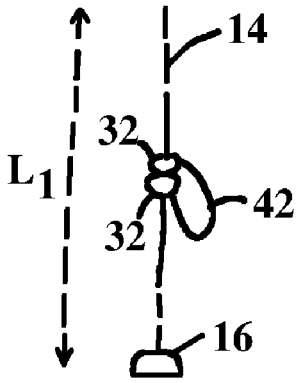
FIG. 4 is a schematic representation indicating how the length of the first elastic member in keeping with the present invention may be shortened to some extent.
Figure 5:
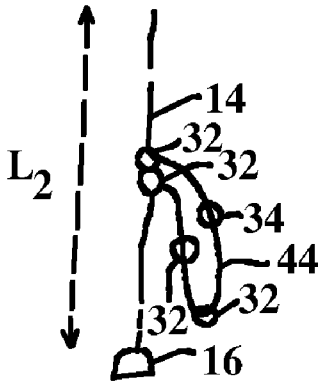
FIG. 5 is a schematic representation similar to that of FIG. 4, indicating how the length of the first elastic member may be shortened to a greater extent than as illustrated in FIG. 4.

Referring now to FIGS. 4 and 5, these figures illustrate the manner in which the effective length of the first elastic member 14 can be shortened. In FIG. 4, two adjacent rings 32 are connected one to the other so that a loop 42 is formed between them. This will result in the length of the first elastic member 14 being shorter than its original length, becoming length $L_1$. It will be understood that the material of the first elastic member which comprises the loop 42 will not be in tension, and that the tension forces which are created in the first elastic member are transferred between the two rings 32 which have been affixed one to the other. The clip which joins rings 32 together is not shown, but this can be provided with a separate clip or a clip 15A included as part of optional hand grasping element 38A.

FIG. 5 shows a situation where a pair of rings 32 which have other rings 32 that are intermediate of the selected pair of rings, are attached one of the other. In the example shown, there are two rings 32 which are attached one to the other, and there are three intervening rings 32 which are now found on the slack loop 44, as before, the length of the first elastic member 14 in the example of FIG. 5 will be shorter still, being in this case length $L_2$. It will also be clear to one skilled in the art that the tension forces in the first elastic member 14 in the example of FIG. 5 will be higher than the tension forces in the first elastic member 14 as shown in FIG. 4, for the same user or a user of the same size.

Figure 6:
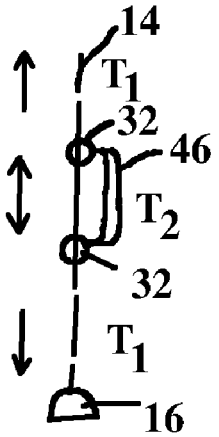
FIG. 6 is another schematic representation indicating how another short elastic member, optionally having higher tensile strength, may be attached to the first elastic member so as to thereby increase the tensile strength of the first elastic member.

Turning to FIG. 6, a further option by which the tension forces in the first elastic member 14 may be increased is shown. Here, $T_1$ represents the original tension in the first elastic member 14, and $T_2$ represents the tensile strength of an additional, preferably stronger elastic member 46. When the first elastic member 14 is put into tension, the tensile strength $T_2$ will be imparted through the entire length of the first elastic member 14, so that an increased tension will be encountered when first elastic member is put into tension in the area of member 46.

Figure 7:
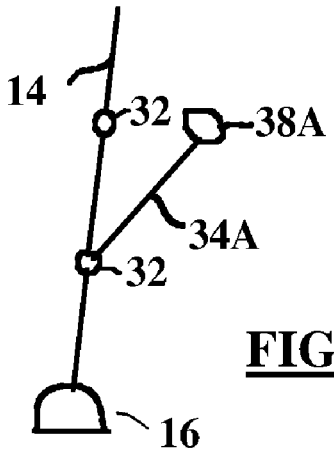
FIG. 7 is a further schematic representation indicating how the tension applied by the first elastic member can be overcome by additional, optional elastic members attached to a user's hand.

Finally, in FIG. 7, a further option is shown wherein an optional hand grasping element 38A, with (or without) a further elastic member 34A, is attached to a ring 32 on first elastic member 14. If the tension of elastic member 14 is too great for a particular user for a selected exercise, then element 38A (with optional elastic element 34A) can be attached to ring 32 so that the user can also use their hands and arms to assist in overcoming the tension of first elastic member 14.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps. Further, the invention illustratively disclosed herein suitably may be practiced in the absence of any element which is not specifically disclosed herein.

Moreover, the word "substantially" when used with an adjective or adverb is intended to enhance the scope of the particular characteristic; e.g., "substantially in a fixed position" is intended to mean, in this particular example, that there shall be no significant relative movement of the back panel 20 with respect to the back of the user, or vice versa.

What is claimed is:

1. An exercise device for performing a variety of resistance and/or aerobic exercises, whereby a chosen muscle group or groups may be exercised by moving against an elastic resistance, comprising:

a first elastic member having a predetermined length when at rest;

a foot strap at each end of said first elastic member and adapted to accommodate the feet of the user;

a vest which is adapted to encircle at least the upper chest and back region of the body of the user and the vest having a belt which is adapted to encircle the user below chest level;

a substantially enclosed pathway having an inverted "U" configuration affixed to said vest in the back region thereof in which part of said first elastic member is placed whereby a portion of said first elastic element is placed in close proximity to the back of the user, the legs of said "U" configuration extend towards said foot straps and each leg having an opening;

wherein, when in place on the body of a user, the predetermined length of the first elastic element is such that the foot straps are above the feet of the user, whereby, when in use where the user's feet are placed into said foot straps, said first elastic member is placed into a first tensile force; and whereby movement of the legs of the user which are associated with said foot straps will be against the elastic resistance of said first elastic member.

2. The exercise device of claim 1, wherein a plurality of clips or rings are secured to said first elastic member along the length of each leg of the "U" configuration, in regions of which that are not in said enclosed pathway; and wherein any pair of clips or rings on each leg of the "U" configuration may be affixed one to the other so as to effectively shorten the at rest length of the first elastic member between said foot straps elements; so that the tensile force in said elastic member will increase.

3. The exercise device of claim 1 additionally comprising a pair of second elastic members having a second predetermined length when at rest, and which are affixed at one end to said vest or said first elastic member in the region near said pathway openings, and affixed at the other ends of said second elastic member to grasping elements which are adapted to fit to the hands or wrists of the user, and wherein said second predetermined length is such that said grasping elements are located between the wrists and shoulders of the user.

4. The exercise device of claim 3, additionally comprising guide means located in the region near said pathway openings, wherein said first or one end of said second elastic members passes through said guide means.

5. The exercise device of claim 4 wherein said guide means having a spacing between them of at least 50% of the width of the user's back at an elevation which is in the region thereof below the armpits and above the waist.

6. The exercise device of claim 5 wherein said guide means are located on the sides of the user.

7. The exercise device of claim 4 wherein said guide means is a loop of material fitted around said second elastic member.

8. The exercise device of claim 3 wherein one or a plurality of rings or clips are secured to said pair of second elastic members along their respective lengths, so that any pair of rings or clips in each second elastic member may be affixed one to the other so as to effectively shorten the at rest length of the second elastic member; so that when said exercise device is used, the tensile force in said second elastic member is increased.

9. The exercise device of claim 2, wherein an additional elastic member having a higher tensile strength than said first elastic member may be affixed to any pair of clips in each leg of the "U" configuration, whereby when said exercise device used, the tension between said grasping elements will be modified.

10. The exercise device of claim 1 additionally comprising a pair of third elastic members attached at one end to said belt in an area in front of said guide means, and attached at an opposite end to different legs of said first elastic member in an area below said belt, so as to apply, when in use, a forward, balancing tension against said first elastic member.

11. The exercise device of claim 1 additionally comprising a fourth elastic member adapted to be connected between said foot straps.

12. The exercise device of claim 11 wherein a plurality of rings or clips are secured to said fourth elastic member along its length, so that any pair of rings or clips in said fourth elastic member may be affixed one to the other so as to effectively shorten the at rest length of the fourth elastic member; so that when said exercise device is used, the tensile force in said fourth elastic member is increased.

13. The exercise device of claim 1, wherein said first elastic member is an elastic tube.

14. The exercise device of claim 13, wherein said first elastic member comprises at least two short elastic tubes connected lengthwise to one another, so that the overall length of said first elastic member is said predetermined length.

15. The exercise device of claim 1, wherein said first elastic member comprises at least three elastic tubes connected lengthwise one to another so that the overall length of said first elastic member is said predetermined length; and wherein the tensile strength of at least two said elastic tubes are different one from the other.

16. The exercise device of claim 2, wherein each leg of said first elastic member has a clip which is adapted to be connected to a clip or ring located on said foot strap.

17. The exercise device of claim 1, wherein said vest has a pair of straps which go over the shoulders of said user, and which are attached at their ends to front and back panels of said vest.

18. The exercise device of claim 2, additionally comprising grasping means.

19. The exercise device of claim 18 wherein said grasping means comprise a hand hold element, a strap, and a ring and/or clip for attachment to any ring or clip on said first elastic member.

* * * * *